US008082865B2

(12) United States Patent
Tseng et al.

(10) Patent No.: US 8,082,865 B2
(45) Date of Patent: Dec. 27, 2011

(54) STATIONARY THREAD-CUTTING DEVICE FOR A SEWING MACHINE

(75) Inventors: Shui-Chun Tseng, Taiping (TW); Chi-Chang Lan, Taiping (TW)

(73) Assignee: Zeng Hsing Industrial Co., Ltd., Taiping (TW)

( * ) Notice: Subject to any disclaimer, the term of this patent is extended or adjusted under 35 U.S.C. 154(b) by 316 days.

(21) Appl. No.: 12/479,172

(22) Filed: Jun. 5, 2009

(65) Prior Publication Data

US 2010/0307400 A1 Dec. 9, 2010

(51) Int. Cl.
*B65H 57/00* (2006.01)

(52) U.S. Cl. ..... 112/302

(58) Field of Classification Search ..... 112/302, 112/285, 295, 260, 291, 298
See application file for complete search history.

(56) References Cited

U.S. PATENT DOCUMENTS

| | | | | | |
|---|---|---|---|---|---|
| 1,883,746 | A * | 10/1932 | Doubler | ..... | 112/292 |
| 4,485,755 | A * | 12/1984 | Marsh et al. | ..... | 112/292 |
| 4,748,925 | A * | 6/1988 | Takei et al. | ..... | 112/260 |
| 5,025,737 | A * | 6/1991 | Kamiya | ..... | 112/296 |
| 7,021,226 | B2 * | 4/2006 | Tseng | ..... | 112/302 |
| 7,194,969 | B2 * | 3/2007 | Niizeki et al. | ..... | 112/260 |

* cited by examiner

*Primary Examiner* — Tejash Patel

(57) ABSTRACT

A stationary thread-cutting device for a sewing machine includes a guiding member and a cutter. The guiding member is mounted on a needle plate, and has a major wall defining a thread guiding route. The guiding route includes a lead-in area having an entry slot to permit entry of a leading end of a bobbin thread, a turn-around area for guiding the leading end, a corner piece disposed at the turn-around area, and a cutting station disposed adjacent to a lateral edge of the needle plate to define a lead-out path with the corner piece. The cutter is disposed under the major wall and adjacent to the cutting station, and has a cutting blade. After the bobbin thread is advanced beyond the cutting station, the bobbin thread is cut, thereby ensuring that a predetermined length of the bobbin thread is available for initial interlacing with a needle thread in a sewing operation.

9 Claims, 6 Drawing Sheets

STATIONARY THREAD-CUTTING DEVICE FOR A SEWING MACHINE

BACKGROUND OF THE INVENTION

1. Field of the Invention

This invention relates to a sewing machine, more particularly to a stationary thread-cutting device for a sewing machine, which guides and cuts a bobbin thread adjacent to a front side edge of a needle plate.

2. Description of the Related Art

In U.S. Pat. No. 7,021,226 B2, the applicant disclosed a sewing machine 1 as shown in FIGS. 1 and 2. The sewing machine 1 includes a needle plate 13 with a cutout part 131 which opens at a lateral edge 132, and a guide plate 14 connected to a bottom side of the needle plate 13 and extending across the cutout part 131. The guide plate 14 has two slide rails 141, an opening 142 corresponding in position to a bobbin holder 11 that holds a bobbin 17, and an arc-shaped thread guiding slot 143 having one end communicated with the opening 142 and another end extending to one of the slide rails 141. A slide cover 15 covers the cutout part 131 and is slidable along the slide rails 141. A thread guiding groove 12 is disposed along one of the slide rails 141 adjacent to the arc-shaped thread guiding slot 143, and has one end connected to the thread guiding slot 143 and another end extending to the lateral edge 132 of the needle plate 13. A cutter 16 includes a cutter blade 161 which is fixed to the bottom side of the needle plate 13 proximate to the lateral edge 132 and the thread guiding groove 12, and which extends across a cutter groove 133 formed in the lateral edge 132.

Since the cutter 16 is mounted at the lateral edge 132 of the needle plate 13, when it is desired to obtain an appropriate length of bobbin thread for interlacing with a needle thread (not shown) for stitching a fabric piece, bobbin thread is drawn from the bobbin 17 held in the bobbin holder 11, is passed through the thread guiding slot 143, a thread tensioning unit (not shown) mounted on the bobbin holder 11, and the thread guiding groove 12, and is pulled into the cutter groove 133 for cutting by the cutter blade 161. However, since the thread guiding groove 12 extends along the slide rail 141, manual threading of the bobbin thread along the thread guiding groove 12 after the bobbin thread is passed through the thread guiding slot 143 is difficult and troublesome. Improvement in this respect is therefore needed. Moreover, it is desirable to improve the aforesaid sewing machine to shorten the required length of the bobbin thread drawn from the bobbin while ensuring good stitching quality.

SUMMARY OF THE INVENTION

An object of the present invention is to provide a stationary thread-cutting device for a sewing machine, which has a guiding member that permits a bobbin thread to be manually led to a thread cutter in a convenient manner, and which is adapted to cut a portion of the bobbin thread so that a predetermined sufficient length of the bobbin thread is available for initial interlacing with a needle thread in a sewing operation and which can ensure good stitching quality.

According to this invention, the stationary thread-cutting device for a sewing machine includes a guiding member and a cutter. The guiding member is adapted to span an access opening of a needle plate of a sewing machine, and has a major wall which includes an outer marginal region adjacent to a lateral edge of the needle plate. The major wall defines a thread guiding route including a lead-in area which has an entry slot extending therethrough so as to permit entry of a leading end of a bobbin thread into the lead-in area, and which is positioned leftwardly of a bobbin, a turn-around area which is disposed downstream of the lead-in area to guide the leading end to turn around so as to permit the leading end to be pulled in a rightward direction, a corner piece which is disposed at the turn-around area to be in a frictional engagement with the bobbin thread so as to impart a tensing force to the leading end when the leading end is pulled in the rightward direction, and a cutting station which is disposed on the outer marginal region and downstream of the turn-around area, and which is disposed rightwardly of the corner piece so as to define a lead-out path with the corner piece. The cutter is disposed under the major wall and adjacent to the cutting station, and has a cutting blade extending through the major wall such that, subsequent to an advancement of the bobbin thread beyond the cutting station by virtue of pulling the leading end along the lead-out path manually, the bobbin thread is brought into contact with the cutting blade to be cut by the cutting blade.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
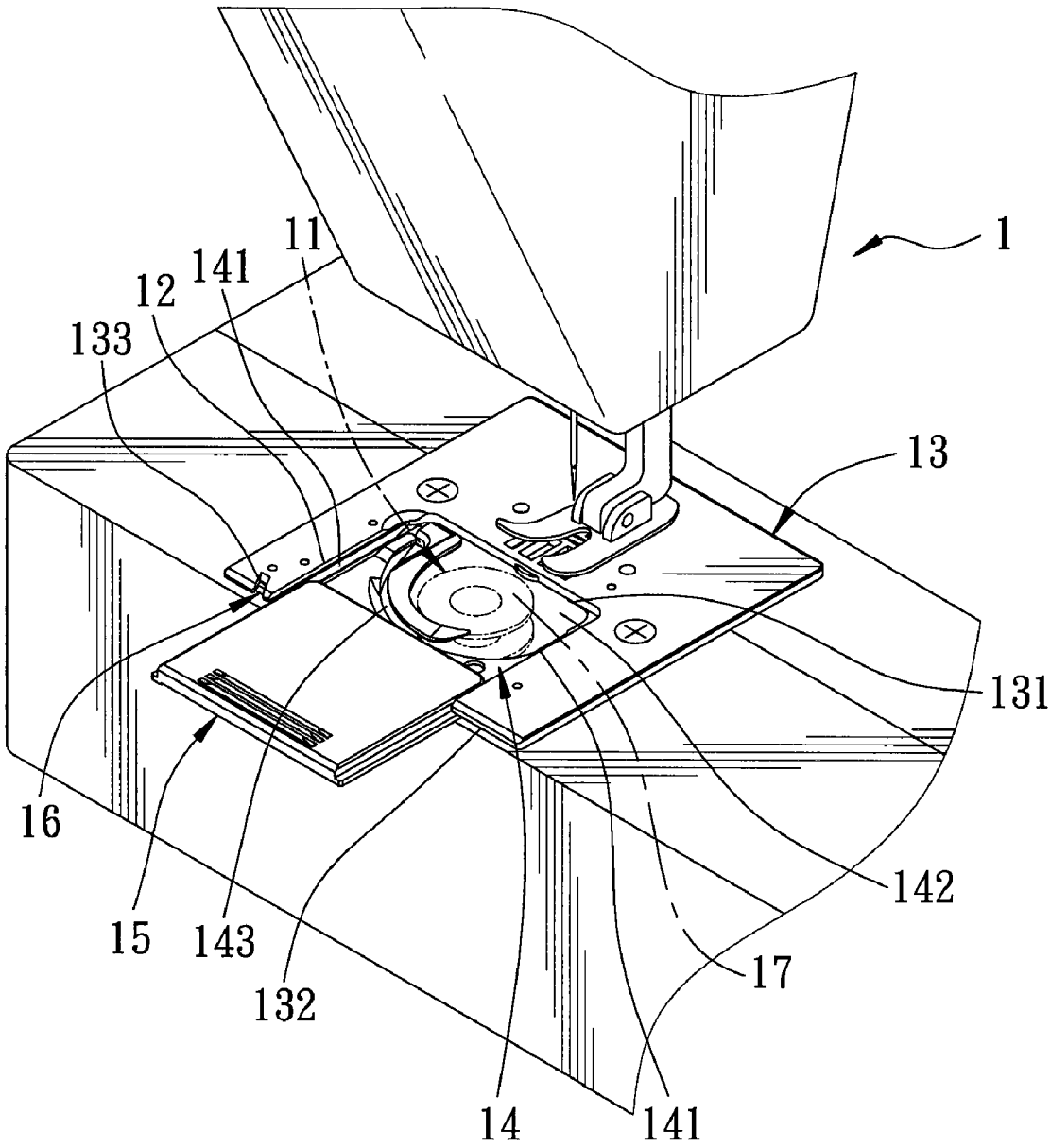
FIG. 1 PRIOR ART
FIG. 1 is a fragmentary perspective view of a conventional sewing machine.
Figure 2:
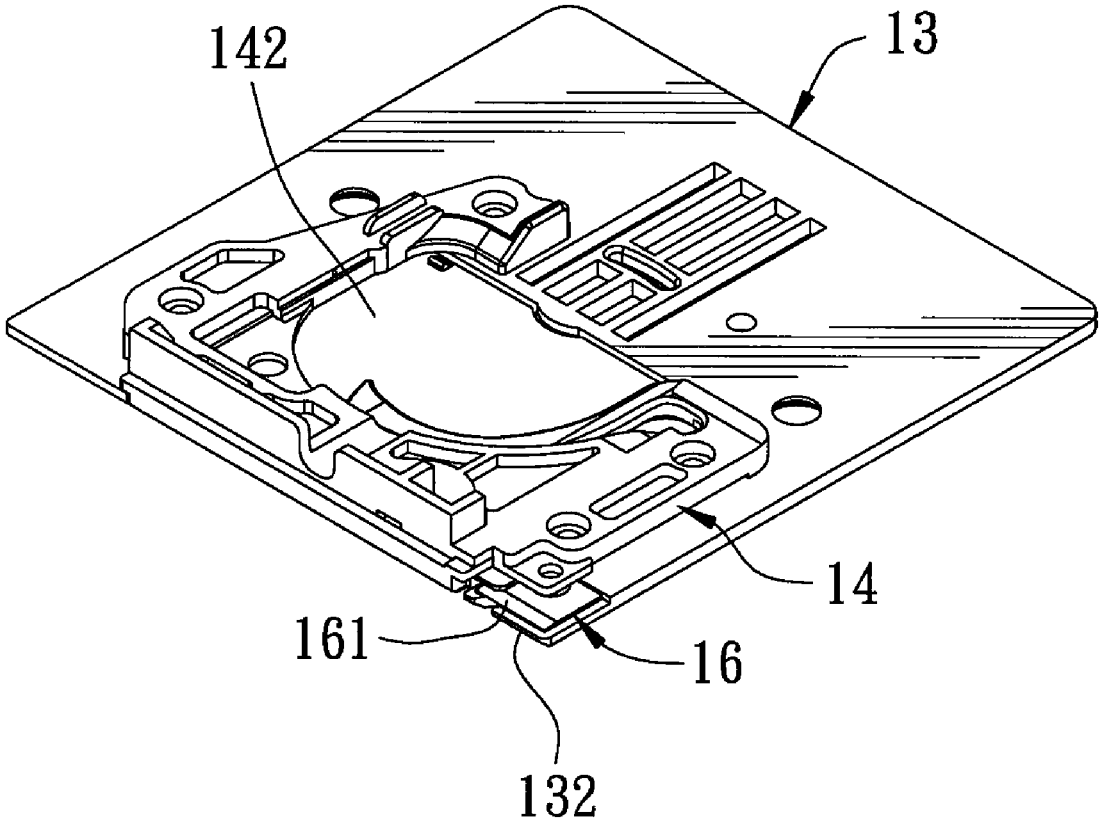
FIG. 2 PRIOR ART
FIG. 2 is a perspective view showing a bottom side of a needle plate of the conventional sewing machine.
Figure 3:
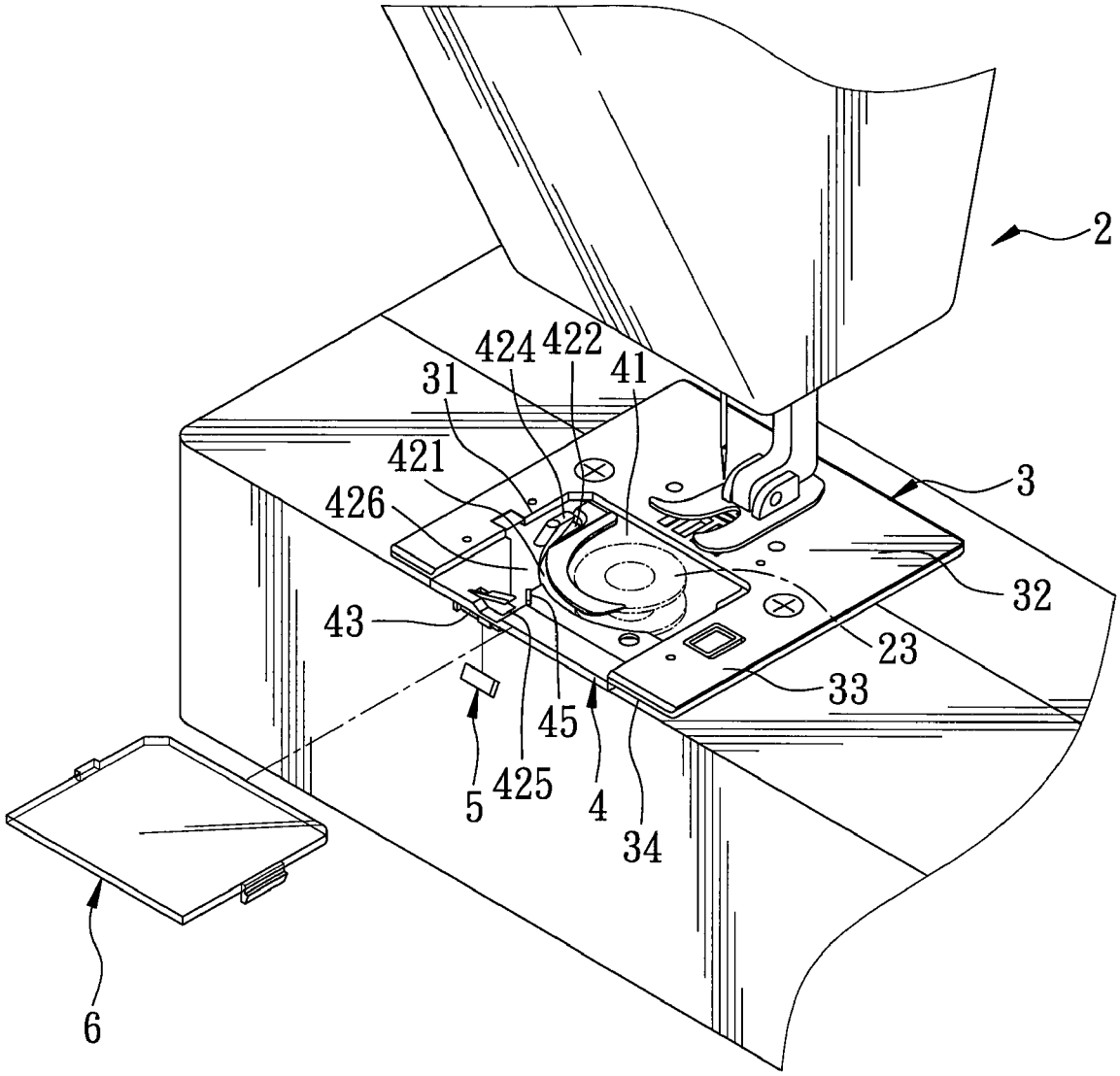
FIG. 3 is an exploded perspective view of the preferred embodiment of a stationary thread-cutting device according to this invention incorporated in a sewing machine.
Figure 4:
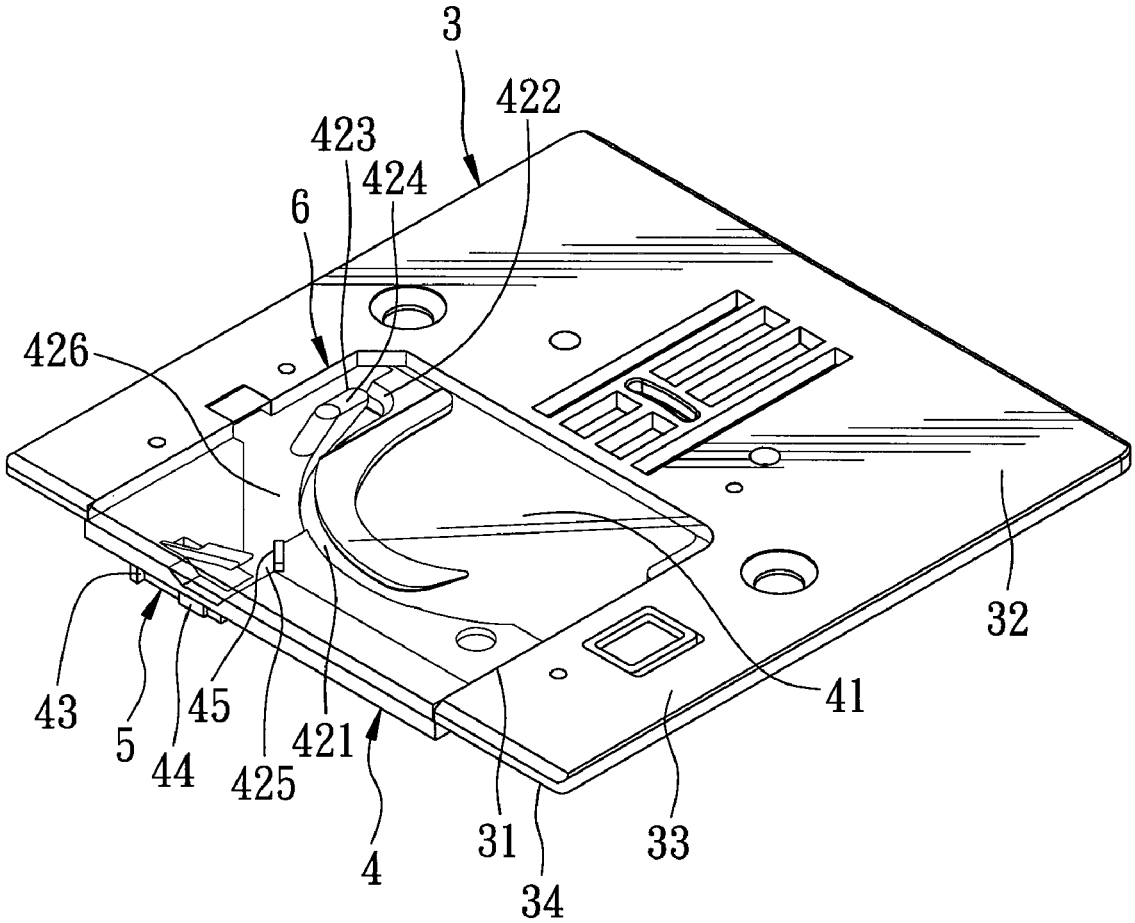
FIG. 4 is a perspective view of the preferred embodiment of the stationary thread-cutting device incorporated in the sewing machine.

Referring to FIGS. 3 to 6, the preferred embodiment of a stationary thread-cutting device according to the present invention is shown to be mounted on a needle plate 3 of a sewing machine 2. The needle plate 3 has a needle-side region 32 for feeding thereinto a piece of fabric to be stitched, and a bobbin-side region 33 which is opposite to the needle-side region 32 in a longitudinal direction, which extends to terminate at a lateral edge 34 distal from the needle-side region 32, and which has an access opening 31. The sewing machine 2 generally includes a bobbin holder (not shown) which is accessible to the access opening 31, and a bobbin 23 which is disposed in the bobbin holder to reel out a bobbin thread 230 that is to be interlaced with a needle thread (not shown) for stitching the fabric piece, and that has a leading end 231 led out of the access opening 31.

The stationary thread-cutting device according to this invention comprises a guiding member 4, a cutter 5, and a cover plate 6.

The guiding member 4 is attached to a bottom side of the needle plate 3, spans the access opening 31, and has a major wall which includes an outer marginal region 47 that extends in a direction transverse to the longitudinal direction, and that is disposed adjacent to the lateral edge 34. The major wall has upper and lower wall surfaces 401,402 opposite to each other in an upright direction, and an opening 41 extending through the upper and lower wall surfaces 401,402 to permit access to the bobbin 23 in the bobbin holder.

The upper wall surface 401 has proximate and distal regions 403,404 relative to the needle-side region 32, and a guiding slot 421, and defines a thread guiding route. The thread guiding route includes a lead-in area 422, a turn-around area 423, a corner piece 424, and a cutting station 425.

The guiding slot 421 is disposed leftwardly of the bobbin 23, is of an arc-shape, and extends angularly from the distal region 404 about a reeling axis of the bobbin 23. The guiding slot 421 further extends through the lower wall surface 402.

The lead-in area 422 has an entry slot 4221 disposed in the proximate region 403. The entry slot 4221 extends through the lower wall surface 402 and is disposed downstream of the guiding slot 421. The leading end 231 of the bobbin thread 230 is pulled out of the access opening 31 and the opening 41 and beyond the upper wall surface 401, and is guided along the guiding slot 421 to the entry slot 4221 to thereby enter into the lead-in area 422. Preferably, the lead-in area 422 is positioned closer to the needle-side region 32 than a tangential point (P) at which the leading end 231 of the bobbin thread 230 is reeled out of the bobbin 23.

The turn-around area 423 is disposed downstream of the lead-in area 422, and is configured to guide the leading end 231 to turn around so as to permit the leading end 231 to be pulled in a rightward direction. The corner piece 424 is disposed at the turn-around area 423, and projects upwardly from the upper wall surface 401 to be in frictional engagement with the bobbin thread 230 so as to impart a tensing force to the leading end 231 when the leading end 231 is pulled in the rightward direction.

Figure 5:
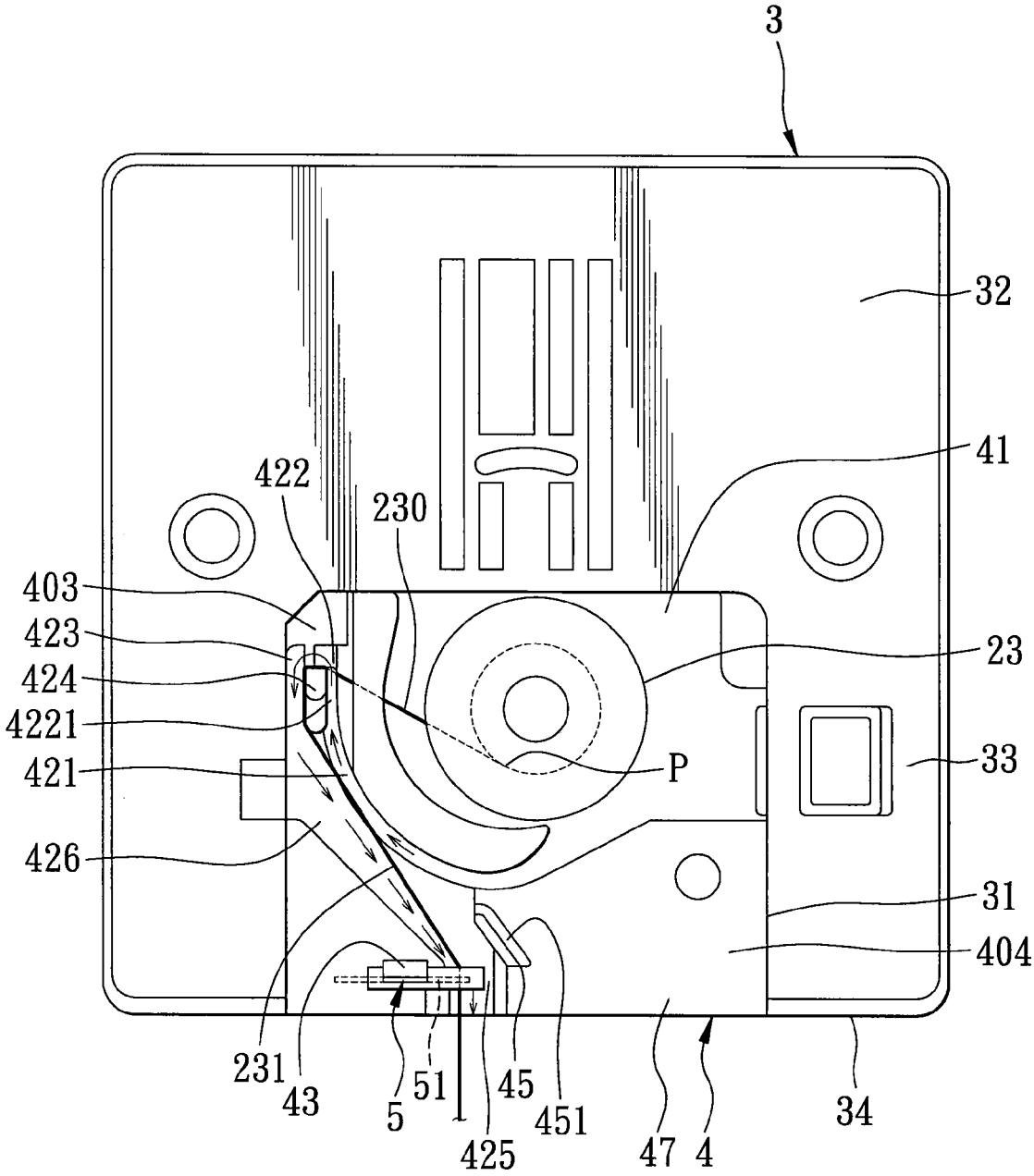
FIG. 5 is a top view showing a bobbin thread mounted in the preferred embodiment.
Figure 6:
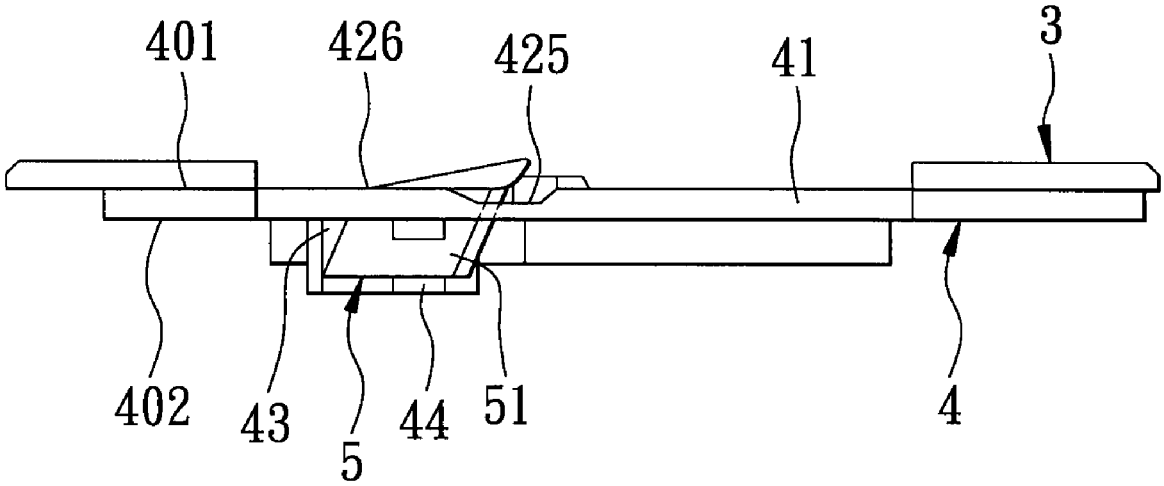
FIG. 6 is a front view of the preferred embodiment.

The cutting station 425 is disposed on the outer marginal region 47 and downstream of the turn-around area 423, and is disposed rightwardly of the corner piece 424 so as to define with the corner piece 424 a lead-out path 426 that crosses the distal region 404. As shown in FIG. 5, the guiding slot 421 partially borders on the lead-out path 426.

The marginal region 47 has a cutting groove 43 which is disposed outwardly of and which borders on the cutting station 425. The cutting groove 43 extends through the lower wall surface 402. Amounting seat 44 is disposed on the lower wall surface 402 adjacent to the cutting groove 43, and is disposed leftwardly of the cutting station 425.

It is noted that the guiding member 4 is integrally formed by an injection molding process, and the cutting groove 43 can be formed at a "shut-off face."

The cutter 5 is secured to the mounting seat 44, and has a cutting blade 51 extending through the upper wall surface 401 from the cutting groove 43. Thus, subsequent to an advancement of the bobbin thread 230 beyond the cutting station 425 by virtue of pulling the leading end 231 along the lead-out path 426 manually, the bobbin thread 230 is brought into contact with the cutting blade 51 and is cut thereby. In this embodiment, the cutting blade 51 is a pencil knife.

Preferably, the upper wall surface 401 further has a barrier 45 disposed on the distal region 404 between the guiding slot 421 and the cutting station 425. The barrier 45 has a side wall 451 extending parallel to the lead-out path 426 so as to prevent the leading end 231 from being pulled into the cutting station 425 when the leading end 231 is led toward the lead-in area 422.

The cover plate 6 is disposed to removably cover the access opening 31 above the guiding member 4.

When it is desired to load a bobbin 23 in the bobbin holder of the sewing machine 2, the bobbin thread 230 is first pulled beyond the upper wall surface 401 and is guided along the guiding slot 421 so that the bobbin thread 230 below the guiding member 4 enters into and is held by a thread tensioning unit (not shown) on the bobbin holder. The leading end 231 of the bobbin thread 230 is further pulled to turn around the corner piece 424, and is subsequently pulled along the lead-out path 426 to the cutting station 425 where the leading end 231 is moved leftwardly to be cut by the cutting blade 51. Thus, the bobbin thread 230 pulled from the bobbin 23 can have a predetermined sufficient length for initial interlacing with the needle thread.

Since the mounting seat 44 on which the cutter 5 is mounted can be integrally formed with the lower wall surface 402, the structure and assembly of the thread-cutting device of this invention are simplified and the manufacturing costs are reduced. In addition, due to the configuration of the guiding member 4, the bobbin thread 230 can be manually led from the lead-in area 422 to the cutting station 425 on the upper wall surface 401 in an easy and convenient manner. Moreover, since the cutter 5 is mounted in the cutting groove 43 which is formed at the end of the lead-out path 426, the length of the bobbin thread 230 available for initial interlacing with the needle thread can be reduced.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. A stationary thread-cutting device for a sewing machine, the sewing machine including a needle plate which has a needle-side region for feeding thereinto a fabric piece to be stitched, and a bobbin-side region that is opposite to the needle-side region in a longitudinal direction, that extends to terminate at a lateral edge distal from the needle-side region, and that has an access opening, a bobbin holder which is accessible to the access opening, and a bobbin which is disposed in the bobbin holder to reel out a bobbin thread that is to be interlaced with a needle thread for stitching the fabric piece, and that has a leading end led out of the access opening, said stationary thread-cutting device comprising:

a guiding member adapted to span the access opening, and having a major wall which includes an outer marginal region that extends in a direction transverse to the longitudinal direction, and that is disposed adjacent to the lateral edge, said major wall having upper and lower wall surfaces opposite to each other in an upright direction, said upper wall surface having proximate and distal regions relative to the needle-side region, and defining a thread guiding route including a lead-in area which has an entry slot extending through said lower wall surface so as to permit entry of the leading end into said lead-in area, and which is positioned leftwardly of the bobbin in said proximate region, a turn-around area which is disposed downstream of said lead-in area, and which is configured to guide the leading end to turn around so as to permit the leading end to be pulled in a rightward direction, a corner piece which is disposed at said turn-around area, and which is configured to be in frictional engagement with the bobbin thread so as to impart a tensing force to the leading end when the leading end is pulled in the rightward direction, and a cutting station which is disposed on said outer marginal region and downstream of said turn-around area, and which is disposed rightwardly of said corner piece so as to define with said corner piece a lead-out path that crosses said distal region; and a cutter which is disposed under said lower wall surface and adjacent to said cutting station, and which has a cutting blade configured to extend through said upper wall surface such that, subsequent to an advancement of the bobbin thread beyond said cutting station by virtue of pulling the leading end along the lead-out path manually, the bobbin thread is brought into contact with said cutting blade to be cut by said cutting blade.

2. The stationary thread-cutting device according to claim 1, wherein said upper wall surface has a guiding slot which is disposed leftwardly of the bobbin and which extends from said distal region to be communicated with said entry slot, said guiding slot extending through said lower wall surface such that the leading end is pulled out of the access opening and beyond said upper wall surface, and is guided along said guiding slot to said entry slot.

3. The stationary thread-cutting device according to claim 2, wherein said guiding slot is of an arc shape, and extends angularly about a reeling axis of the bobbin.

4. The stationary thread-cutting device according to claim 2, wherein said guiding slot partially borders on the lead-out path.

5. The stationary thread-cutting device according to claim 2, wherein said upper wall surface further has a barrier which is disposed on said distal region between said guiding slot and said cutting station and which is configured to prevent the leading end from entering into said cutting station when the leading end is led toward said lead-in area.

6. The stationary thread-cutting device according to claim 5, wherein said barrier has a side wall which extends parallel to the lead-out path.

7. The stationary thread-cutting device according to claim 1, wherein said marginal region has a cutting groove which is disposed outwardly of and which borders on said cutting station, said cutting groove being configured to extend through said lower wall surface so as to permit said cutting blade to extend through said upper wall surface, said stationary thread-cutting device further comprising a mounting seat which is disposed on said lower wall surface and adjacent to said cutting groove, and which is disposed leftwardly of said cutting station for mounting said cutter on said mounting seat.

8. The stationary thread-cutting device according to claim 1, further comprising a cover plate which is disposed to removably cover the access opening.

9. The stationary thread-cutting device according to claim 1, wherein said lead-in area is positioned to be closer to the needle-side region than a tangential point at which the leading end of the bobbin thread is reeled out of the bobbin.

* * * * *